United States Patent [19]

Wixon

[11] Patent Number: 4,524,012

[45] Date of Patent: Jun. 18, 1985

[54] FABRIC SOFTENING AND FLUFFING DETERGENT COMPOSITION

[75] Inventor: Harold E. Wixon, New Brunswick, N.J.

[73] Assignee: Colgate-Palmolive Company, New York, N.Y.

[21] Appl. No.: 500,590

[22] Filed: Jun. 8, 1983

[51] Int. Cl.[3] ..... C11D 9/06; C11D 3/12; C11D 7/10; D06M 13/00

[52] U.S. Cl. ..... 252/174; 252/8.6; 252/89.1; 252/131; 252/133; 252/140; 252/174.25

[58] Field of Search ..... 252/8.6, 140, 131, 174.25, 252/133, 89.1, 174

[56] References Cited

U.S. PATENT DOCUMENTS 4,292,035 9/1981 Battrell ..... 252/547

4,326,971 4/1982 Wixon ..... 252/8.8

*Primary Examiner*—John E. Kittle

*Assistant Examiner*—Mukund J. Shah

*Attorney, Agent, or Firm*—Herbert S. Sylvester; Murray M. Grill; Norman Blumenkopf

[57] ABSTRACT

A fabric softening and fluffing particulate detergent composition comprises a detersive proportion of an anionic synthetic organic detergent, such as sodium linear higher alkylbenzene sulfonate, a building proportion of a builder for the detergent, such as sodium tripolyphosphate, sodium carbonate and/or sodium silicate, a fabric softening proportion of bentonite, and a softening and fluffing proportion of a magnesium salt, which is at least slightly water soluble, such as magnesium sulfate. The basic detergent composition, containing the detergent and builder, sometimes with inert filler and preferably with desirable adjuvants, is preferably in the form of spray dried beads, and the bentonite and magnesium salt are preferably agglomerated together to particles of about the same size as the spray dried beads, and are mixed with the spray dried beads.

The invention also relates to the mentioned agglomerate and to processes for making the detergent composition and the agglomerate.

20 Claims, No Drawings

FABRIC SOFTENING AND FLUFFING DETERGENT COMPOSITION

This invention relates to a detergent compositions and methods for the manufacture thereof. More particularly, it relates to detergent compositions which have fabric softening effects, very preferably accompanied by fabric fluffing effects, and to fabric softening and fluffing compositions which are useful additives for detergent compositions, making them capable of softening and fluffing laundry washed with such modified detergent compositions. The invention also relates to processes for the manufacture of such additives and of improved detergent compositions containing them.

Particulate laundry detergent compositions comprising organic detergent, builder(s) for such detergent and various suitable adjuvants have received wide acceptance and today are almost universally used for machine washing of laundry, fabrics and textiles. While such products satisfactorily clean the laundry when used in automatic washing machines, they often leave washed materials feeling less soft than is desirable. Accordingly, softening agents have been incorporated in detergent compositions to improve this characteristic of such products. Among such softening agents that have been found to be useful are clays of various types, preferably swellable clays, and of these the bentonites have been successfully employed to give washed materials a softer feel. It has been theorized that this is accomplished by the very finely divided bentonite particles adhering to the washed goods and providing lubricious sliding plate-like structures on the fibers which lubricate them so that they slide past one another more readily giving the impression of softness.

To obtain excellent softening effects of built detergent compositions comparatively large proportions of bentonite have often been employed. While such proportions of bentonite are tolerable in many compositions, in others they may have negative effects. Thus, the bentonite, if used as in its natural clay form or if not whitened by processing may be of an off-color and this could adversely affect the appearance of a white or light colored detergent composition. Also, sometimes the increased proportion of insolubles in the detergent composition may be disadvantageous, possibly causing a lightening in the appearance of dark colored laundry that has been washed with such a composition, and in other cases causing such a buildup of insoluble bentonite particles on the laundry as to make the laundry feel heavier and tactilely less satisfactory. Accordingly, research has been conducted in an effort to improve the effects of bentonite in laundry detergent compositions, with some aims of such research being to improve the softening effect of the bentonite on fabrics washed with laundry detergent compositions containing it. By means of the present invention such objective has been achieved and additionally, improved fluffiness of washed laundry, such as all-cotton towels, has been noted.

In accordance with the present invention a fabric softening and fabric fluffing particulate detergent composition comprises spray dried beads containing a detersive proportion of an anionic synthetic organic detergent and a building proportion of a builder for such detergent, a fabric softening proportion of bentonite, which is capable of softening fabrics during washing thereof with the anionic detergent and builder, and a softening and fluffing proportion of a magnesium compound which is at least slightly water soluble, in such proportion that it improves the softening effect of the bentonite and improves the fluffiness of the fabrics washed with the detergent composition, which bentonite and magnesium salt are external to the spray dried beads of anionic synthetic organic detergent and builder.

Various anionic detergents, usually as sodium salts, may be employed but those which are most preferred are linear higher alkyl benzene sulfonates, higher alkyl sulfates and higher fatty alcohol polyethoxylate sulfates. Preferably, in the higher alkyl benzene sulfonate the higher alkyl is linear and of 12 to 15 carbon atoms, e.g., 12 or 13, and is a sodium salt. The alkyl sulfate is preferably a higher fatty alkyl (or higher fatty alcohol) sulfate of 10 to 18 carbon atoms, preferably 12 to 16 or 18 carbon atoms, e.g., 12, 16, and is also employed as the sodium salt. The higher alkyl ethoxamer sulfates will similarly be of 10 or 12 to 18 carbon atoms, e.g., 12, 18, in the higher alkyl, which will preferably be a fatty alkyl, and the ethoxy content will normally be from 3 to 30 ethoxy groups per mol, preferably 3 or 6 to 15 or 20. Again, the sodium salts are preferred. The alkyls are preferably linear or fatty higher alkyls of chain lengths within the 10 to 18 carbon atoms range, the cation is preferably sodium, and when a polyethoxy chain is present the sulfate is at the end thereof. Preferred anionic detergents are sodium linear tridecyl (or dodecyl) benzene sulfonate, sodium tallow alcohol sulfate and sodium tallow alcohol polyethoxylate sulfate wherein the polyethoxylate is of 6 to 15 ethylene oxide groups. Others that are also useful are the sodium higher olefin sulfonates and the sodium higher paraffin sulfonates. In addition to the anionic detergents mentioned, others of this well known group may also be present, especially in only minor proportions with respect to those previously described. Most such useful anionic detergents include an anionic base portion which includes a long chain alkyl. Mixtures of anionic detergents may be employed and in some cases such mixtures can be superior to single detergents. The various anionic detergents are well known in the art and are described at length at pages 25 to 138 of the text *Surface Active Agents and Detergents,* Vol. II, by Schwartz, Perry and Berch, published in 1958 by Interscience Publishers, Inc. These and other anionic detergents are described by trade name and characteristics in the series of books issued under the title *McCutcheon's Detergents and Emulsifiers,* and specifically in the 1969 Annual.

Instead of anionic detergents, amphoteric or ampholytic detergents may be employed providing that under the conditions of use they act like anionic products. Such detergents are also described in the Schwartz et al. text and in the mentioned *Detergents and Emulsifiers Annual.*

Although it is considered that anionic or anion-active detergents should be components of the present compositions for the desirable softening and fluffing effects to be obtained this does not mean that in addition to such detergents other detersive materials may not also be present. For example, higher fatty acid soaps, usually sodium soaps of fatty acids of 10 to 20 carbon atoms, preferably 12 to 18 carbon atoms, which may be made by neutralization of fatty acids or by neutralization of fats and oils, especially of mixtures thereof, may be present in the invented compositions for their foam diminishing and detersive actions and it has been noted that the soaps, especially soaps like those of mixed tallow and coconut oil or hydrogenated tallow and coconut oil, with the ratios thereof being in the range of about 3:1 to 9:1 are especially good. Additionally, nonionic detergents may be present with the anion-active detersive materials and in some instances small proportions of cationic detergents may also be employed. The cationic detergents, which have softening activities in their own rights, are preferably quaternary ammonium salts, e.g., dimethyl dilauryl benzylammonium chloride, cetyl trimethyl ammonium bromide. However, usually the cationic detergents are in separate particles from the anionic detergents to limit any undesirable interactions, and are processed in such a manner as not to be in intimate contact with the anionic detergents, also to limit such reactions. Of the nonionic detergents, which are also described in the texts previously mentioned (and the cationic detergents are also listed therein), most preferable are condensation products of ethylene oxide and propylene oxide with each other or with hydroxy-containing compounds, such as higher fatty alcohols (although higher alkyl phenols, such as nonyl phenols, and Oxo-type alcohols may also be used). In the preferred products the higher fatty alcohols are of 10 to 20 carbon atom, preferably 12 to 16 carbon atoms, and the nonionic detergent contains from about 3 to 20 or 30 ethylene oxide groups per mol, preferably from 6 to 12 or 15. More preferably, the nonionic detergent will be one in which the higher fatty alcohol is of about 12 to 13 or 15 carbon atoms and which contains about 6, 6.5, 7 or 11 moles of ethylene oxide. Among such detergents are those made by Shell Chemical Company, available under the trade names Neodol® 23-6.5 and 25-7. Among their especially attractive properties, in addition to good detergency with respect to oily marks on goods to be washed, is a comparatively low melting point, yet appreciably above room temperature, so that they may be sprayed onto base beads as a liquid which quickly solidifies. Such nonionic detergents may be incorporated in limited proportion, e.g., 2 to 4%, in a crutcher mix from which spray dried built detergent beads are made, or may be post-sprayed in liquid state onto tumbling base beads (with larger proportions of the nonionic being feasible).

The builders that improve the detergency of the synthetic organic detergent (and often also improve the detergency of the water soluble soaps that may be employed) may be either the more conventional water soluble builders or the water insoluble builders. Among the former, both inorganic and organic builders may be useful, most of which are salts, preferably alkali metal salts, e.g., sodium salts. Among the inorganic water soluble builders those of preference are the various phosphates, usually polyphosphates, such as tripolyphosphates and pyrophosphates, especially the former. For example, pentasodium tripolyphosphate and tetrasodium pyrophosphate may be used. Of course, carbonates, such as sodium carbonate, are useful builders and may desirably be employed, alone or in conjunction with bicarbonates, such as sodium bicarbonate. Sodium sesquicarbonate may be utilized instead of such carbonates. Other water soluble inorganic builders which are considered to be effective in the present compositions include various other phosphates, borates, e.g., borax, and silicates, e.g., sodium silicate of $Na_2O:SiO_2$ ratio of about 1:2.4. As the water soluble organic builders it is preferred to utilize citrates, gluconates, phosphonates, nitrilotriacetates, iminodiacetates and ethylene diamine tetraacetates. Preferably, all such compounds are alkali metal salts and more preferably they are sodium salts.

Among the water insoluble builders the most acceptable are the zeolites, preferably synthetic zeolites of Type A, X or Y, although some natural zeolites and other synthetic zeolites may also be utilized. Of the synthetic zeolites Type 4A is most preferable. Dehydrated crystalline zeolites are considered to be more effective in the present compositions than the amorphous zeolites and usually it is preferred to employ hydrated or partially hydrated zeolites. These compounds are excellent as hardness ion removers from hard water and serve effectively to build synthetic organic detergents, especially anionic synthetic organic detergents. Usually they will have calcium ion exchange capacities in the range of 200 to 400 or more milligram equivalents of calcium carbonate hardness per gram of the aluminosilicate, preferably 250 to 350 mg. eq./g. Also, they will normally include up to 9 molar proportions of water of hydration, preferably about 2.5 to 6 such proportions. Such zeolite ultimate particle diameters will usually be in the range of 0.01 to 20 microns and the zeolite particles will be of sizes within the range of 100 to 400 mesh, preferably 140 to 325 mesh (U.S. Sieve Series Nos.).

In addition to the synthetic detergents and builder the particulate materials which, together with the agglomerated bentonite and magnesium compound, make up the detergent compositions of this invention, may include some moisture and one or more adjuvants or mixtures thereof. Among the adjuvants may be mentioned fluorescent brighteners, pigments, inorganic filler salts, bead structure modifiers, e.g., sodium polyacrylate, colorants, bactericides, fungicides, flow promoting agents, enzymes, bleaches and perfumes. The more stable of such materials may often be mixed in with other components of the crutcher mix and may be spray dried. Those which are less stable may be post-added, agglomerated or otherwise incorporated by less sensitive manufacturing methods. Thus, the more stable of the adjuvants may be components of the spray dried beads and the less stable thereof may be agglomerated with the bentonite and magnesium compound or may be otherwise post-added to the present compositions.

The bentonite utilized is preferably a Wyoming or western bentonite having a swelling capacity in the range of 3 to 20 ml./gram, preferably 7 to 15 ml./g., and its viscosity, at a 6% concentration in water, will usually be in the range of 3 to 30 centipoises, preferably 8 to 30 centipoises. Preferred swelling bentonites of this type are sold under the trademark Mineral Colloid, as industrial bentonites, by Benton Clay Company, an affiliate of Georgia Kaolin Co. Such materials were formerly marketed under the trademark THIXO-JEL by such company. They are selectively mined and beneficiated bentonites, and those considered to be very useful are available as Mineral Colloid 101, etc., and correspond to those formerly sold as THIXO-JELs Nos. 1, 2, 3 and 4. These materials have pH's (6% concentration in water) in the range of 8 to 9.4, maximum free moisture contents of about 8% and specific gravities of about 2.6, and for the pulverized grade about 85% passes through a 200 mesh U.S. Sieve Series sieve. Beneficiated Wyoming bentonite is preferred as a component of the present compositions but other bentonites are also useful, especially when they form only a minor proportion of the total of bentonite used. Although it is desirable to limit free moisture content, as mentioned, it is more important to make certain that the bentonite being employed includes enough moisture, most of which is considered to be present between adjacent plates of the bentonite, to facilitate quick disintegration of the bentonite and any adjacent materials in the particles when such particles or detergent compositions containing them are brought into contact with water, such as when the detergent composition is added to the wash water. It has been found that at least about 2%, preferably at least 3%, more preferably at least 4% and most preferably 5% or more, to about 8%, of water should be present in the bentonite initially, before it is admixed with the other bead components in the crutcher, and such a proportion of moisture should also be present after spray drying. In other words, overdrying to the point where the bentonite loses its "internal" moisture can significantly diminish the utility of the present compositions. Thus, it is preferred not to spray dry the bentonite with other detergent composition components. When the bentonite moisture content is too low the bentonite does not act to the extent that is possible to prevent any silicate-zeolite agglomerates being formed and it also does not aid enough in disintegrating the beads in the wash water. Additionally, when the bentonite is of satisfactory moisture content it exhibits an exchangeable calcium oxide percentage in the range of about 1 to 1.8 and with respect to magnesium oxide such percentage will normally then be in the range of 0.04 to 0.41, which exchange capacity is desirable.

In place of Mineral Colloid 101 or other commercial bentonite of the type previously mentioned there may also be employed an equivalent bentonite such as one supplied by American Colloid Company. This product, which may be available in powdered or agglomerated form, will generally comprise at least 90% of montmorillonite, 65%±3% of $SiO_2$, 18%±3% of $Al_2O_3$, 3.5%±0.3% of $Fe_2O_3$, 2.4%±0.6% of MgO, 2.5%±0.2% of $Na_2O$, 0.5%±0.2% of CaO and 5.5%±0.5% of water of crystallization. The loss on ignition will be 11%±1% and any soluble silicate, usually with a $Na_2O:SiO_2$ ratio of 1:2.4, and present as a binding agent in the agglomerate, often will be limited to 2%.

In powder form the bentonite may pass through or almost pass through a No. 200 or No. 325 sieve but in agglomerated form it will normally be between No. 10 and No. 140 sieve size, such as 30–100, preferably all or at least about 90% being within the Nos. 10 to 100 or 10 to 120 range and preferably all being in the 40 to 100 range. Thus, a sieve test will preferably have 0% beads on a No. 30 sieve, 75% minimum on a No. 80 sieve and no more than 10% through a No. 100 sieve. The dispersibility of the product will be 1.5 minutes maximum, its swelling rate will be 20 milliliters per minute and its frangibility will be 20% maximum in 15 minutes and 25% maximum in 30 minutes, as measured by standard evaluation tests. The apparent density of such product will usually be less than 0.7 g./ml. and preferably it will be approximately that of the spray dried beads, often 0.3 to 0.5 g./ml., to prevent excessive sifting when such agglomerates are blended with the spray dried beads. The physical properties mentioned above are those which are desirable for agglomerates made from either bentonite powder or from such a powder in which a magnesium compound has been incorporated.

Instead of the described bentonites others of comparable fabric softening properties may also be employed providing that they are improved in fabric softening characteristics by the magnesium compound in accordance with this invention. Some bentonites which are not initially satisfactorily fabric softening may be improved by alkali treatment, as by treatment of Italian bentonite with sodium carbonate, and such materials are available as Laviosa clays. Such clays may be employed and do soften laundry when they are present in detergent compositions, but they have not been found to be as satisfactory as western or Wyoming bentonites which are preferably employed in accordance with the present invention.

The magnesium compounds which are useful in the invented products and which increase the fabric softening effects of fabric softening bentonite also make various laundry items fluffier, especially those made of cotton, (so that a stack of towels, for example, will be higher after being washed in a product of this invention than when washed in a bentonite containing detergent composition which is such that an equivalent softness of laundry results after washing). The magnesium compound utilized is normally one which is characterized as being water soluble, although, as will be evident from the following discussion, magnesium compounds that are at least slightly water soluble may also be used. Thus, when 0.2%, for example, of a magnesium compound, such as a magnesium salt, e.g., magnesium sulfate, is present in a detergent composition which is employed at a concentration of 0.15% in wash water for an automatic washing machine, the concentration of the magnesium compound will be 0.0003% or three parts per million. Accordingly, providing that the magnesium compound dissolves to such a extent in the wash water it could be effective. Similarly, a magnesium compound which dissolves to the extent of 30 parts per million in water could be dissolved to the extent of two grams per 65 liters (normal American washing machine capacity) and such concentration or approximately such concentration of such a compound is considered to be preferred. Of course, if it is the magnesium ion that is important to produce the desired improvement in softening and fluffing of washed laundry the proportion of magnesium compounds may be adjusted to provide a desired magnesium ion concentration. However, for simplicity, and because it is considered that often the compounds can be used substantially interchangeably, the amounts, proportions or concentrations of anhydrous magnesium compounds employed will be referred to herein.

The most useful magnesium compounds are magnesium salts and the water soluble magnesium salts are preferred. Of these the best is considered to be magnesium sulfate, which may be employed in the anhydrous form, as the monohydrate, the heptahydrate or $MgSO_4.2.5\ H_2O$. Synthetic kieserite, such as is available from RAD Co., preferably ground to be between Nos. 80 and 100, U.S. Sieve Series, is a preferred source of magnesium. Another useful source thereof is a 1:1 mixture of magnesium sulfate and sodium carbonate. Other very useful magnesium salts include magnesium acetate, magnesium citrate, magnesium chloride, magnesium bromide, magnesium nitrate and magnesium carbonate. The magnesium carbonate is preferably a basic magnesium carbonate, such as one of the formula $4MgCO_3.Mg(OH)_2.n\ H_2O$, wherein n equals 3 or 4.

The compositions of this invention will usually comprise from 5 to 35% of anionic synthetic organic detergent, 10 to 80% of builder, 4 to 30% of bentonite, and 0.2 to 5% of magnesium compound. Preferred ranges are 8 to 25% of the anionic detergent, 25 to 60% of builder, 5 to 15 or 20% of bentonite and 1 to 3 or 4% of magnesium compound. Also preferably present is from 5 to 40% of inorganic filler salt, such as sodium sulfate. Thus, a detergent composition according to this invention may comprise from 5 or 10 to 35% of sodium higher linear alkyl benzene sulfonate wherein the linear alkyl is of 12 to 13 carbon atoms, 5 to 40% of sodium tripolyphosphate, 2 to 10% of sodium silicate, 5 to 40% of sodium sulfate, 5 to 15 or 20% of bentonite, 1 to 3 or 4% of magnesium sulfate and 4 to 15% of moisture. Moisture contents may be from 2 to 20% but normally will not be outside the 4 to 15% range and usually preferably will be from 5 to 12%. Generally, the detergent compositions will contain no more than about 30% of adjuvants but when both sodium sulfate and sodium perborate are present in the final compositions (with the perborate normally being in distinct particulate form) higher proportions, up to 50 or 60%, may be employed. Generally, when no perborate or other sensitive bleach is present the adjuvants will be limited to about 30% and when the sodium sulfate content is minimized the adjuvants may be held to 10%, e.g., 1 to 10%.

The above proportions of components are with respect to detergent compositions containing bentonite and magnesium compound. In such compositions the major proportion of material is in spray dried bead form, with the bentonite and magnesium compound being external to such beads. Thus, powdered or beaded bentonite and powdered or beaded magnesium compound may be mixed with the spray dried detergent-builder beads and with any other adjuvants desired but very preferably the bentonite and the magnesium compound will be agglomerated together into beads or particles to be mixed with the other particles. Such mixtures of beads are esthetically desirable and are functionally superior because sifting on transportation and in storage is limited.

In the bentonite-magnesium compound agglomerates the proportion of bentonite to magnesium compound will be such that upon addition of the agglomerate to the spray dried beads of other detergent composition components the end product will be of a formula such as those previously described, in which the bentonite will exert a softening effect and the magnesium compound will improve such softening effect and improve the fluffiness of fabrics washed with the detergent composition. Such proportion of bentonite to magnesium compound, by weight, will usually be within the range of 20:1 to 1:1 or 1:2, preferably 10:1 to 2:1 and more preferably 6:1 to 3:1. The percentage of such agglomerate in the final detergent product will normally be within the range of 4 to 50%, preferably 6 to 30% and more preferably 8 to 25%.

The bulk density of the detergent product, often in the range of 0.25 to 0.65 g./ml., will preferably be such that the amount to be employed in standard automatic washing machine operations will be conveniently measurable volumetrically. Thus, when the density is 0.34 g./ml., 1¼ cup of product will weigh 100 grams and if that amount is employed per wash the washing concentration of the detergent composition will be the desired 0.15%. Similarly, if the bulk density is 0.43 g./ml. only one cup of the detergent composition need be employed to obtain the same concentration. Of course, hand washing concentrations of the detergent composition will usually be appreciably more, normally being from 0.15 to 0.5%, whereas machine washing concentrations will usually be from 0.05% (in some applications) to 0.2%.

The bentonite-magnesium compound agglomerates will normally comprise about 7 to 64% of magnesium compound (anhydrous basis), 26 to 87% of bentonite and 4 to 15% of moisture, with 0.5 to 5% of a binder preferably being present to assist in maintaining the integrity of the agglomerate until it is added to water, in which it is readily disintegrable and dispersible. Preferably, the magnesium compound is magnesium sulfate, which may be added as synthetic kieserite, preferably of particle size in the 80–100 mesh range, or as epsom salt, and the binder is sodium silicate, preferably of $Na_2O$:-$SiO_2$ ratio in the range of 1:1.6 to 1:3, e.g., about 1:2.4. In such compositions the proportions of the magnesium sulfate, bentonite, sodium silicate and moisture are about 10 to 30%, 60 to 80%, 1 to 3%, and 5 to 12%, respectively, and the agglomerate particles are of sizes within the range of Nos. 10 to 100 or 120, U.S. Sieve Series, preferably 30 to 100. The above proportions of bentonite and magnesium compound may also be employed when such materials are dry mixed together and such mixture is then admixed with the other detergent component beads, or when the different materials are separately admixed with such beads, whether or not the bentonite and/or magnesium compound or mixture of such compounds are/is previously agglomerated. In a modification of the formula of the agglomerate a quaternary ammonium salt softening agent, such as distearyl dimethyl ammonium chloride, may be incorporated in the agglomerate to the extent of 0.1 to 3% as a softening and anti-static agent (to prevent cling of laundry after washing and machine drying).

The bentonite-magnesium compound agglomerates may be made by spraying water or an aqueous solution of a binder onto moving surfaces of the bentonite and the magnesium compound, which have been pre-mixed, and keeping particles in motion until a major proportion thereof is agglomerated so as to be within a desirable size range. When that happens the moisture content of the agglomerate may be in the range of about 20 to 40% and the binder content, if present, as is preferable, will be about 1 to 5% when its concentration in the mobile aqueous spray solution employed is in the range of about 2 to 20%. The spray will usually contain 0.5 to 20% of binder, preferably 2 to 10% thereof. The binder concentration in the agglomerate will frequently be from 0.5 to 10%, e.g., 1 to 3%, when the binder is sodium silicate. The moisture content of the agglomerated particles, as a result of the spraying onto them of the binder solution or dispersion, will normally be higher than desired initially but when anhydrous magnesium sulfate, for instance, is employed, the heat of hydration will help to drive off some of the moisture. If the final moisture is too high it may be lowered to the desired range of about 4 to 15%, preferably to a level about the same as the desired moisture content of the final detergent composition, by conventional drying means, such as a fluid bed dryer.

The binding spray solution employed will often be at an elevated temperature, such as in the range of 65° to 85° C. but room temperature spraying is also feasible. The spray will be in finely divided droplet form and will preferably be directed transversely onto a moving screen of particles in the agglomerator.

Various apparatuses may be used to carried out the agglomeration but that which is most preferred is an O'Brien agglomerator. However, other means, such as the simpler inclined drum agglomerators may also be employed. The residence time in the agglomerator, whether operated continuously or as a batch, will usually be within the range of 10 to 30 minutes but this depends on the design and operation of the agglomerator, as will be apparent to those of skill in this art.

The spray dried beads of anionic detergent and builder, together with other components which may be present therein, such as suitable adjuvants, are made by conventional spray drying methods. Thus, an aqueous crutcher mix comprising the anionic detergent, such as sodium higher linear alkylbenzene sulfonate wherein the linear alkyl is of 12 to 13 carbon atoms, the builder or a mixture of builders, such as sodium tripolyphosphate, sodium silicate and sodium carbonate, with sodium sulfate as a filler, at a 40 to 70% solids concentration, and at a temperature of 50° to 70° C., may be crutched for sufficient time to make the mix uniform, usually from 5 to 30 minutes, after which it is spray dried by being pumped through spray nozzles of a conventional countercurrent spray drying tower in which heated drying air (products of combustion of oil or gas) at an inlet temperature of about 400° to 600° C. drives off enough of the moisture content of the sprayed droplets of the crutcher mix to form the desired beads. The beads resulting will preferably be substantially in the Nos. 10 to 120 range (or 10–100) but may be and often are screened to such range(s). The beads will be satisfactorily free flowing at the desired moisture content thereof, which will usually be within the 4 to 15% range.

After manufacture of the spray dried detergent-builder beads and agglomeration of the bentonite-magnesium compound beads these may be mixed together in conventional blending equipment, such as a Day mixer or other suitable blender, after which the product may then be packaged and shipped or sent to storage pending shipment.

The fabric softening agglomerates of this invention are useful for addition to conventional detergent compositions to improve the fabric softening and fabric fluffing properties thereof. Thus, a conventional detergent composition may be transformed into a fabric softening and fluffing detergent product by mere mixing with the described agglomerate beads in a suitable proportion. The invented fabric softening and fluffing detergent compositions represent significant advances in the detergent art because they significantly improve fabric softening and do it with less of the fabric softening bentonite being required. Thus, the relatively small proportion of magnesium compound, such as magnesium sulfate, which is present, significantly increases the fabric softening action of the bentonite, often to an extent that would otherwise require twice the bentonite content. This permits the production of detergent compositions which are less chalky or milky in aqueous solution and could tend less to cause objectionable whitening of dark colored fabrics. In addition to improving softening qualities the relatively small proportion of magnesium compound acts to whiten the bentonite, making its appearance more attractive. In some instances the magnesium compound aids in evaporating excess moisture from the product during agglomeration and it has been observed that it promotes the breakup of the agglomerate when the detergent composition is added to the wash water. Additionally, the magnesium compound, especially the sulfate, contributes to the fluffing effect of the compositions, making washed laundry, such as cotton towels, fluffier, so that a stack of towels, after five washings with the invented detergent composition, will be higher than a stack after washings with a composition of comparable formula but containing no magnesium sulfate and containing enough bentonite to achieve equivalent softening effects. When bentonite and/or magnesium compound are/is added in the crutcher and formed into the spray dried beads the desirable improvement in softening and fluffing are not obtained to such a significant extent, if at all, and if other metal salts than that of magnesium are used with bentonite such improvements do not result. Also, the presence of a quaternary ammonium halide softening agent in the agglomerate, which is optional, will further help to soften the laundry and make it static-free and the quaternary ammonium compound does not deteriorate in manufacture or on storage because it is not objectionably reactive with the magnesium compound or the bentonite. Of course, if the quaternary ammonium halide softener had been added to the crutcher or was kept in intimate contact with anionic detergent it would deteriorate and its softening and anti-static effects would be lost.

The following examples illustrate but do not limit the invention. Unless otherwise indicated, all parts are by weight and all temperatures are in °C.

EXAMPLE 1

| | Percent |
|---|---|
| Sodium tridecylbenzene sulfonate | 15.0 |
| Sodium tripolyphosphate | 32.0 |
| Sodium silicate ($Na_2O:SiO_2$ = 1:2.4) | 7.0 |
| Sodium carbonate | 17.0 |
| Sodium sulfate | 18.0 |
| Adjuvants | 2.0 |
| Moisture | 9.0 |
| | 100.0 |

A 60% solids aqueous crutcher mix is made of the above components in the given proportions of solids so that on spray drying the beads resulting will be of the formula given. The crutcher mix is mixed for a period of about 20 minutes at a temperature of about 70° C. and is dried in a countercurrent spray drying tower to which the drying air is admitted at a temperature of about 450° C. and into which the mix is pumped at high pressure through conventional spray nozzles. The resulting beads are screened so as to be in the particle size range of Nos. 10 to 100, U.S. Sieve Series.

A commercial swelling bentonite, found to be useful as a detergent composition fabric softener, which is sold under the trade name Mineral Colloid 101, as a finely divided powder of particle sizes about No. 325, U.S. Sieve Series, is agglomerated in a 1:1 ratio with anhydrous magnesium sulfate. To effect the agglomeration a mixture of both finely divided powders is made in the given proportion and while it is being tumbled in an inclined drum agglomerator (or an O'Brien agglomerator) deionized water is sprayed onto a falling curtain of the mixture, created in the agglomerator. The spraying of the water onto the tumbling mixture of powders and the tumbling are continued until the desired extent of agglomeration is obtained. After the particles have reached the desired size range they are dried to desired moisture, about 10%, in a fluidized bed dryer or other suitable dryer. The agglomerate resulting is next screened to desired particle sizes, in the Nos. 10 to 100 sieve range, and is ready for blending with the spray dried detergent composition beads to make an improved composition that softens and fluffs washed laundry. The agglomerate analyzes about 45% of each of the bentonite and magnesium sulfate and about 10% of moisture. The spray dried detergent beads and the agglomerate are then blended together in a suitable mixer, such as a Day mixer or a V- or twin shell blender in a 5:1 proportion of detergent beads to agglomerate beads.

The detergent composition resulting is noted to appear whiter than agglomerates of bentonite alone, which is considered to be desirable. The composition is then tested for softening activity, using a General Electric Company washing machine, with water at a hardness of 100 p.p.m., as calcium carbonate, and at a temperature of 49° C. The concentration of the detergent composition is 0.18% in the wash water and after completion of normal washing the washed material is dried in a laundry dryer.

A test towel that is washed and dried in accordance with the described procedure is evaluated for softness by an expert, who follows an evaluation procedure by which softness of laundry is rated on a scale from 1 to 10, with 10 representing the softest laundry. On such a scale the washed and dried towel is given a softness rating of 9. When the same experiment is repeated, with a different but essentially identical towel being washed with a dry blend of five parts of the spray dried detergent composition and one part of Mineral Colloid 101, without the $MgSO_4$, the softness rating given is 8. When the immediately preceding test is repeated except for cutting the amount of Mineral Colloid 101 in half in the dry blend (and using 0.15% of the blend in the wash water) the softness rating is 7. When next the Mineral Colloid is omitted entirely (or the invented agglomerate is omitted) and the concentration is 0.15% the softness rating is 1. Softness ratings of 9 and 10 are recognizable as significantly superior to ratings of 8 and 7 and it is considered that commercial products with such higher ratings achieve higher acceptance for softening effects by consumers.

The towel washed with the formula product, which had a softness rating of 9, is also noticeably fluffier than the other towels, which were washed with the other products. When the test is modified by having the washed towel line dried instead of having it dried in an automatic laundry dryer greater differences between the formula composition and the modifications thereof will be noted and the formula composition will be even more significantly preferred.

When the swelling bentonite of this example is replaced by an equivalent swelling bentonite sold under the name American Colloid Bentonite Clay, essentially the same results are obtained. When however, a sodium carbonate-treated Italian or European bentonite, sold under the name Laviosa clay, is substituted for the Mineral Colloid 101, somewhat poorer results are obtained, although such results are relatively similar.

The above-reported experiments may also be varied by using a 5% sodium silicate ($Na_2O:SiO_2$ ratio of 1:2.4) solution in water as the spray for spraying onto the mixture of bentonite and magnesium compound, with the spray being heated to a temperature of about 65° C. and with the amount of sodium silicate in the agglomerate resulting being about 2%. Instead of the sodium silicate solution, similar solutions of other binding agents, such as polyvinyl alcohol, sodium carboxymethyl cellulose, polyvinyl pyrrolidone and hydroxyethyl cellulose, may be used to improve the physical strength of the agglomerate and prevent disintegration thereof. When the agglomerate containing binder is tested for softness and fluffiness the detergent composition containing the agglomerate of bentonite and magnesium compound is still superior to compositions of the other types previously described (except for other bentonite-magnesium compound agglomerates). Such is also the case when the agglomerates are of particle sizes in the Nos. 30–100 range, U.S. Sieve Series.

When instead of anhydrous magnesium sulfate, RAD Co. synthetic kieserite, epsom salt or other magnesium sulfate hydrate is utilized or when magnesium acetate, basic magnesium carbonate, magnesium chloride, magnesium nitrate or other at least slightly soluble magnesium compound is employed, completely or partially in replacement of the magnesium sulfate in the described agglomerates with the bentonite (although it is preferred to use those of a solubility of at least 10 g./l. in room temperature water), improved softening (and fluffiness) of washed fabrics (such as cotton towels) result, compared to similar formulations containing more bentonite but no magnesium compound with the agglomerate. When the same proportions of bentonite and magnesium compound are dry blended with the spray dried beads softening and fluffing results, measured on fabrics washed with such compositions, are about the same as or almost as good as those utilizing the agglomerates but the products tend to segregate on shipping and storage and the softening effects are not uniform for all of the product in the box of detergent composition. Also, the appearance of the product is not as acceptable aesthetically and the presence of fine powdered material with the detergent beads is considered undesirable by consumers.

When 1 or 2%, on a product basis, of distearyl dimethyl ammonium chloride, an anti-static and fabric softening agent, is included in the agglomerate of this invention, by being dissolved and/or dispersed in the binder solution or by being otherwise mixed in with the agglomerate, its anti-static action on washed laundry is apparent, especially when that laundry includes synthetic organic polymeric fibrous materials, such as nylons and polyesters, and it is considered that it further helps to soften cottons in the laundry.

Good results are obtained in accordance with the invention by substituting other anionic detergents, such as sodium lauryl sulfate and polyethoxylated sodium cetyl sulfate containing about 10 moles of ethylene oxide per mole, for the sodium tridecylbenzene sulfonate. Similarly, substituting other builders, such as tetrasodium pyrophosphate, sodium sesquicarbonate and NTA results in generally the same desirable properties in the product. Such is also the case when the proportions of the various components are varied ±10%, ±20% and ±30%, providing that they remain within the ranges given. Of course, all the products described are useful synthetic organic detergents for washing laundry and all clean the laundry satisfactorily.

EXAMPLE 2

| | Percent |
|---|---|
| Sodium dodecylbenzene sulfonate | 19.9 |
| Sodium tripolyphosphate | 27.7 |
| Sodium silicate ($Na_2O:SiO_2$ = 1:2.4) | 10.5 |
| Sodium carbonate | 17.3 |
| Sodium sulfate | 15.4 |

-continued

| | Percent |
|---|---|
| Fluorescent brightner (Tinopal CBS-X) | 0.1 |
| Moisture | 9.1 |
| | 100.0 |

Spray dried detergent-builder beads of the above formula are made by essentially the same spray drying method described in Example 1. The beads are of particle sizes in the 10–100 sieve range. An agglomerate of American Colloid Bentonite Clay and anhydrous magnesium sulfate is made by dry mixing such materials in an inclined drum agglomerator, with the ratio of the bentonite to the magnesium compound being 4:1, the mixture thereof is oversprayed with a dilute (5%) sodium silicate solution in the manner described in Example 1 and agglomerates are formed. The agglomerates are dried to a final moisture content of about 10% and are sieved so that they pass through a No. 40 sieve and rest on a No. 100 sieve. The final sodium silicate content of the agglomerates varies but it is usually within the range of 1 to 3%, e.g., 2%.

The spray dried detergent beads, the bentonite-magnesium compound agglomerate and borax dots (puffed borax colored with Acid Blue 80) are then dry blended together, with the percentages thereof in the blend being 87%, 12% and 1% respectively.

The product resulting is an attractive, free-flowing fabric softening and fluffing detergent composition which, when used at a concentration of 0.15% in the wash water of an automatic washing machine (100 g./65 l. of water) is an excellent detergent of very satisfactory softening characteristics and good cotton fluffing properties.

When the crutcher mix is changed so as to include hydrated Zeolite 4A (20% hydration water) in place of the sodium tripolyphosphate, and sodium bicarbonate in place of some ($\frac{1}{4}$ to $\frac{3}{4}$) of the sodium carbonate of the formula a satisfactory non-phosphate softening detergent composition results. Also, when mixtures of Zeolite 4A and other builders, such as sodium sesquicarbonate or equal weight mixtures of sodium bicarbonate and sodium carbonate are utilized with the zeolite, or when other zeolites which remove calcium from hard water, such as other Zeolites A and Zeolites X and Y are employed, similar good results are obtainable. The excellent fabric softening is especially noted when the laundry is of cotton and such results are obtainable using others of the described anionic synthetic organic detergents (which may be accompanied by nonionic detergents or amphoteric detergents), builders, bentonites and magnesium compounds and when the proportions of the required components of the compositions are varied but are still within the mentioned ranges. A preferred substitute builder is tetrasodium pyrophosphate, which may be used alone or with sodium tripolyphosphate. Also, various adjuvants, such as fluorescent brighteners, colorants, germicides and anti-redeposition agents, may be added in the crutcher and different fillers or no filler may be present in the crutcher mix (and in the spray dried beads). Among adjuvants that may be present in the agglomerate are perfumes, enzymes, soil release promoting agents, and other heat-sensitive products. Of course, as with the case of the borax dots, materials may be present in the final composition external to both the spray dried beads and the agglomerates, which materials may be agglomerates, prills or powders. Among such materials are bleaches, such as sodium perborate, and enzymes, and perfumes may be sprayed onto the mixture of detergent beads and agglomerates. Such modifications of the final products, and processes for their manufacture still permit the obtaining of the improved softening and fluffing results previously mentioned.

As indicated in Example 1, when only bentonite is present in the detergent composition (magnesium compound omitted) but the compositions are otherwise like those of this example, even when the amount of bentonite is increased the products of this invention soften laundry better and additionally, make it fluffier.

EXAMPLE 3

A commercial heavy duty laundry detergent (FAB), based on sodium linear higher alkylbenzene sulfonate wherein the alkyl is of 13 carbon atoms, and sodium tripolyphosphate, with sodium sulfate as a filler and containing moisture, with the percentages of synthetic organic detergent, builder, filler, moisture and other adjuvants being about 15, 55, 20, 9 and 1, is improved with respect to fabric softening effect by mixing the beads thereof with an agglomerate of equal parts of Thixo-Jel No. 1 (bentonite) and $MgSO_4$. Manufacture of the agglomerate is by essentially the same method as was previously described, wherein silicate is used to improve bead strength. The blend made is of five parts of the FAB to one part of the agglomerate. Washing in an automatic washing machine is conducted at a 0.15% FAB concentration (total composition concentration being 0.18%), with the water being at 21° C. and of 100 p.p.m. hardness (as calcium carbonate). The test laundry washed in the laboratory in a washing machine includes two cotton face cloths and after washing such are line dried. They are then evaluated for softness in the manner previously described and are given a rating of 9.

When the above test is repeated, using one part of agglomerated Thixo-Jel with the FAB in replacement of the Thixo-Jel-$MgSO_4$ agglomerate, the softness rating obtained is 8. When both such experiments are repeated using wash water at a temperature of 49° C., the same results are obtained.

In similar tests employing six pound clean loads of laundry in which there are present three face cloths, with the FAB concentration being 0.15% in 20° C. wash water of 100 p.p.m. hardness, as calcium carbonate, agglomerates containing two parts of $MgSO_4$ and ten parts of bentonite are made and are blended with 100 parts of the FAB (to give a wash water concentration of 0.17%). When the bentonite is Thixo-Jel No. 1 each face cloth is rated 9 for softness and is found to be very fluffy, and the same is true when the bentonite is American Colloid Bentonite Clay.

EXAMPLE 4

A commercial American heavy duty laundry detergent (FAB) is made into a softening and fluffing detergent by addition thereto of 12 parts per hundred of an agglomerate of American Colloid Bentonite Clay and $MgSO_4$ (4:1 ratio). The magnesium sulfate employed in three variations of this experiment is in anhydrous form, is crystals of monohydrate and is finely ground crystals of the monohydrate. In another experiment instead of an agglomerate being used, the magnesium sulfate monohydrate crystals, of particle sizes like those of the FAB, are dry blended with agglomerated American Colloid Bentonite Clay (which does not contain any $MgSO_4$). All four of these variations of the invention are compared for fabric softening activity to 100 parts of FAB plus 20 parts of agglomerated American Colloid Bentonite Clay.

Cotton cloths washed with the "control" are rated 8 for softness and cloths washed in the compositions containing the invented agglomerates are rated 9, which difference is considered to be very significant. The composition made with the dry blend of $MgSO_4$ (monohydrate) and bentonite is rated 7.

EXAMPLE 5

To simulate European-type detergent compositions a heavy duty detergent composition is made by blending 10 parts of sodium linear tridecylbenzene sulfonate (derived from FAB), 5 parts sodium coco-tallow soap (20:80 ratio), 32 parts of sodium tripolyphosphate and 25 parts of sodium perborate. To 100 parts of such product are added 12 parts of an agglomerate of 5 parts of American Colloid Bentonite Clay and 1 part of $MgSO_4$.

The described composition is tested for softening power in a Miele washing machine, using wash water of a hardness of 300 p.p.m., as calcium carbonate, and employing 100 grams of the detergent composition per wash, with six pound clean loads being washed. The washing is conducted with water at a temperature of 60° C. and after completion of the washing the dried laundry (cotton) is evaluated for softness and is given a softness rating of 9. It is also noted that apparently due to the presence of the soap the amount of foaming that would normally be expected from the sodium tridecylbenzene sulfonate is greatly diminished, thereby aiding the washing effect. Despite the presence of the soap, which might be expected to react with the magnesium compound to form insoluble soap, which has a lesser effect in softening laundry, the high softness rating is obtained.

The above examples show that the agglomerates of bentonite and magnesium compound of this invention, when incorporated with anionic detergent-based detergent compositions, are effective detergents,significantly improve the softening power of such compositions and improve the desirable fluffiness of the laundry. The compositions also are good whitening agents and help to remove stains from fabric substrates. With respect to fluffiness, in some cases it has been noted that stacked towels are as much as 43% higher than towels of similar softness washed with compositions wherein only bentonite is the softening agent. It has been theorized that the improved softening might be due to reaction of magnesium ion with the synthetic organic detergent to form some magnesium detergent, in which case a small proportion thereof might desirably be included in the agglomerate or in the "external" phase (external to the spray dried detergent beads) to obtain desirable softening and fluffing effects. However, this theory has not yet been verified and accordingly the described invention should be considered on its own merits, without being limited by the theory.

In addition to machine washing of laundry it is also considered that the products of this invention are useful as detergent compositions for hand washing (and line drying) laundry. The concentrations thereof in the wash water will be higher, often being from 0.2 to 1%, e.g., 0.35%, 0.7%, but the softenings are usually not as good as when a washing machine is used. Still, the invented compositions are more effective softeners than those from which the magnesium compound is omitted.

The invention has been described with respect to various examples thereof but is not to be limited to these because it is evident that one of skill in the art with the present description before him will be able to utilize substitutes and equivalents without departing from the invention.

What is claimed is:

1. A fabric softening and fabric fluffing particulate detergent composition which comprises spray dried beads containing a detersive proportion of an anionic synthetic organic detergent and a building proportion of a builder for such detergent, a fabric softening proportion of bentonite, which is capable of softening fabrics during washing thereof with the anionic detergent and builder, and a softening and fluffing proportion of a magnesium compound which is at least slightly water soluble, in such proportion that it improves the softening effect of the bentonite and improves the fluffiness of the fabrics washed with the detergent composition, which bentonite and magnesium compound are external to the spray dried beads of anionic synthetic organic detergent and builder.

2. A detergent composition according to claim 1 wherein the bentonite is in the form of an agglomerate which disintegrates readily in wash water.

3. A detergent composition according to claim 2 wherein the magnesium compound is a magnesium salt and is present with bentonite in at least a portion of the bentonite agglomerate.

4. A detergent composition according to claim 3 which consists essentially of 5 to 35% of anionic synthetic organic detergent, 10 to 80% of builder, 4 to 30% of bentonite, and 0.2 to 5% of magnesium salt.

5. A detergent composition according to claim 4 wherein the magnesium salt is magnesium sulfate, 1 to 4% thereof is present in the composition, and it is distributed evenly in all the bentonite agglomerate.

6. A detergent composition according to claim 5 wherein the proportion of magnesium sulfate to bentonite in the magnesium sulfate-bentonite agglomerate is from 1:20 to 1:1.

7. A detergent composition according to claim 6 consisting essentially of from 5 to 35% of sodium higher linear alkylbenzene sulfonate wherein the linear alkyl is of 12 to 13 carbon atoms, 5 to 40% of sodium tripolyphosphate, 2 to 10% of sodium silicate, 5 to 20% of sodium carbonate, 5 to 40% of sodium sulfate, 5 to 20% of bentonite, 1 to 4% of magnesium sulfate and 4 to 15% of moisture, the particles of which are in the range of Nos. 10–120, U.S. Sieve Series.

8. A detergent composition according to claim 6 wherein the builder is a water softening and calcium ion exchanging zeolite and the proportion thereof in the composition is from 5 to 40%.

9. A detergent composition according to claim 7 wherein the sodium linear higher alkylbenzene sulfonate, sodium tripolyphosphate, sodium silicate, sodium carbonate and sodium sulfate are in spray dried bead form, of particle sizes in the Nos. 10–100 range, U.S. Sieve Series, and the bentonite-magnesium sulfate agglomerates are of particle sizes in the Nos. 30–100 range, include as a binding agent from 0.5 to 5%, on the basis of the agglomerate weight, of sodium silicate, and are of a moisture content in the range of 4 to 15%.

10. A detergent composition according to claim 1 wherein the magnesium compound is magnesium sulfate.

11. A detergent composition according to claim 1 wherein the builder is a mixture of builders, the anionic synthetic organic detergent and builder are in the form of spray dried beads, the magnesium compound is magnesium sulfate and the bentonite and magnesium sulfate are agglomerated to particles of about the same size as the spray dried beads of anionic synthetic organic detergent and mixed builders.

12. A particulate fabric softening and fluffing composition suitable for incorporation in detergent compositions for softening and fluffing laundry washed with such compositions, which comprises agglomerates of finely divided bentonite which is capable of softening fabrics during washing thereof with such detergent composition, and a magnesium compound which is at least slightly water soluble, in such proportion that it improves the softening effect of the bentonite and improves the fluffiness of fabrics washed with the detergent composition.

13. An agglomerated fabric softening and fluffing composition according to claim 12 wherein the magnesium compound is magnesium sulfate.

14. A composition according to claim 13 which consists essentially of about 7 to 64% of magnesium sulfate, 26 to 87% of bentonite, 0.5 to 5% of a binder in the agglomerate to assist in maintaining the integrity of the agglomerate until it is added to water, in which it is readily disintegrable and dispersible, and 4 to 15% of moisture.

15. A composition according to claim 14 wherein the binder is sodium silicate, the proportions of magnesium sulfate, bentonite, sodium silicate, and moisture are about 10 to 30%, 60 to 80%, 1 to 3% and 5 to 12%, respectively, and the particles are of sizes within the range of Nos. 10–120, U.S. Sieve Series.

16. A process for manufacturing a fabric softening and fluffing particulate detergent composition which comprises making an aqueous crutcher mix containing 40 to 70% of solids, including anionic synthetic organic detergent and a building proportion of a builder for such detergent, spray drying the crutcher mix to produce spray dried beads of particle sizes in the Nos. 10–120 range, U.S. Sieve Series, agglomerating a powdered bentonite which is capable of softening fabrics during washing thereof in wash water containing the anionic detergent and builder, with a magnesium compound which is at least slightly soluble in water, which improves the fabric softening effect of the bentonite and which improves the fluffiness of washed fabrics, said agglomerate being of particle sizes in the Nos. 10–120 sieve range, and mixing together the spray dried and agglomerated particles in such proportion that the fabric softening bentonite is present in the composition in a fabric softening proportion and the proportion of magnesium compound present is such as to improve the fabric softening properties of the bentonite and improve the fluffiness of fabrics washed with the detergent composition.

17. A process according to claim 16 wherein the crutcher mix is at a temperature in the range of 50° to 90° C., the crutcher mix comprises sodium higher linear alkylbenzene sulfonate wherein the linear alkyl is of 12 to 13 carbon atoms, sodium tripolyphosphate, sodium silicate, sodium carbonate, sodium sulfate and water, in such proportions that upon spray drying the crutcher mix and blending it with the agglomerate the composition resulting comprises 10 to 35%, 5 to 40%, 4 to 10%, 5 to 20% and 5 to 40% of such non-aqueous components, respectively, from the spray dried portion of the composition, and 1 to 4% of magnesium sulfate and 5 to 20% of bentonite from the agglomerated portion of the composition.

18. A process according to claim 17 wherein about 0.5 to 5% of a binder is present with the bentonite in the agglomerate and said binder is sprayed onto tumbling bentonite powder as a mobile aqueous solution of a concentration of 0.5 to 20% in water.

19. A process according to claim 18 wherein the binder is sodium silicate of $Na_2O:SiO_2$ ratio of about 1:2.4.

20. A process for manufacturing a particulate fabric softening and fluffing agglomerate, useful for incorporation in detergent compositions for softening and fluffing laundry washed with such compositions, which comprises mixing together bentonite and magnesium sulfate, tumbling such mixture and spraying onto such mixture until it agglomerates into suitably sized larger particles, a mobile aqueous solution of sodium silicate of $Na_2O:SiO_2$ ratio of about 1:2.4 so as to produce agglomerates of particle sizes in the range of Nos. 30–100, U.S. Sieve Series, and containing about 10 to 30% of magnesium sulfate, 60 to 80% of bentonite, 1 to 3% of sodium silicate and 5 to 12% of moisture.

* * * * *